US008052230B2

(12) United States Patent
Vicek

(10) Patent No.: US 8,052,230 B2
(45) Date of Patent: Nov. 8, 2011

(54) "HANDY KITCHEN", PNEUMATICALLY POWERED, MOVABLE CABINETS

(76) Inventor: Richard Antony Vicek, Sun City, CA (US)

( * ) Notice: Subject to any disclaimer, the term of this patent is extended or adjusted under 35 U.S.C. 154(b) by 0 days.

(21) Appl. No.: 12/661,917

(22) Filed: Mar. 26, 2010

(65) Prior Publication Data

US 2011/0234067 A1 Sep. 29, 2011

(51) Int. Cl.
*A47B 51/00* (2006.01)

(52) U.S. Cl. ..... 312/247; 312/310; 312/319.8

(58) Field of Classification Search ..... 312/319.1, 312/319.3, 319.5, 319.8, 245, 246, 247, 310, 312/294, 322, 312
See application file for complete search history.

(56) References Cited

U.S. PATENT DOCUMENTS

| | | | | | |
|---|---|---|---|---|---|
| 2,854,307 | A * | 9/1958 | Londeree et al. | ..... | 312/247 |
| 3,285,682 | A * | 11/1966 | Nelson | ..... | 312/312 |
| 4,915,461 | A * | 4/1990 | Kingsborough et al. | ..... | 312/247 |
| 5,450,800 | A * | 9/1995 | Leonard | ..... | 108/7 |
| 5,857,756 | A * | 1/1999 | Fehre | ..... | 312/246 |
| 6,367,898 | B1 * | 4/2002 | Jobe | ..... | 312/246 |
| 6,471,311 | B1 * | 10/2002 | Snyder | ..... | 312/247 |
| 2004/0148934 | A1 * | 8/2004 | Pinkerton et al. | ..... | 60/646 |
| 2005/0212233 | A1 * | 9/2005 | Hall | ..... | 280/33.991 |
| 2008/0164762 | A1 * | 7/2008 | Pecile | ..... | 307/66 |
| 2009/0044026 | A1 * | 2/2009 | Li et al. | ..... | 713/300 |

* cited by examiner

*Primary Examiner* — James O Hansen

(57) ABSTRACT

A lifting system for lifting a floor mounted cabinet from a stored position located on a floor to a raised position where a centerline of the cabinet would be between 38-40 inches above the floor and approximately eye level to a person seated in a wheelchair. A pneumatic power source and a low voltage electric power system coupled with inner and outer frames enables movement of the cabinet between the stored and raised positions.

5 Claims, 7 Drawing Sheets

"HANDY KITCHEN", PNEUMATICALLY POWERED, MOVABLE CABINETS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field

Figure 1:
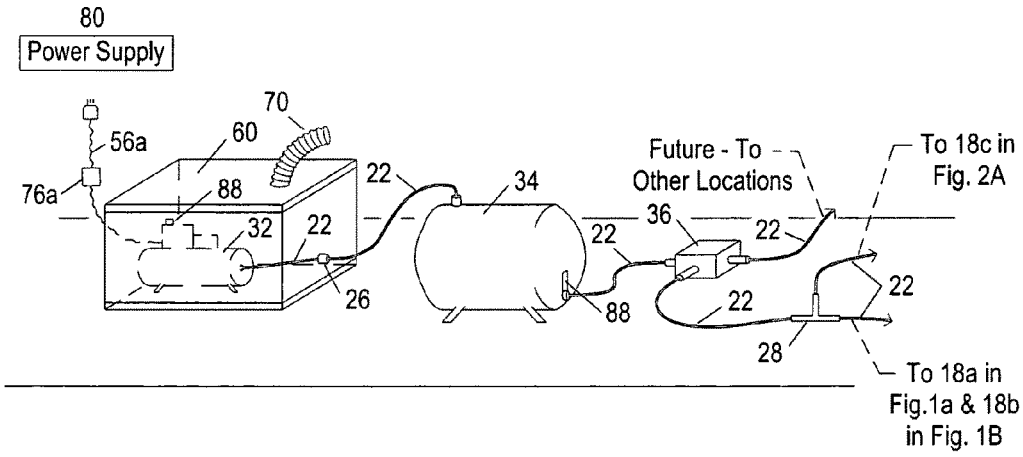

This Application relates to a multiple amount of movable cabinets in one location. These cabinets are placed primarily in the kitchen, pantry, closet, and garage. They can also be used in educational, commercial, and industrial facilities. The air compressor and air reservoir storage tank are supported by a low voltage electric system. This is a power source to control movement of all connected cabinets.

2. Prior Art

No prior art related to my application was found.

In past years, numerous inventors developed inventions intended to help people with handicaps. This was done in an effort to help them with everyday tasks such as reaching upper and lower cabinets. These inventions have also been developed for the general public as a simple convenience for everyday work and living environments.

The first group of inventors choose only mechanical means and no use of any power source, for example:

U.S. Pat. No. 2,555,254 to Stebins (1951), No. 2,473,239 to Boyd (1949), No. 6,336,692 To Snyder (2002), No. 6,752,475 B2 to Steadman (2004), No. 2,950,158 to Harmon (1960), No. 4,009,918 to MacDonald (1977), No. 4,942,328 to Price (1990), No. 2,592,760 to Sutera (1952), No. 4,534,601 to Zwick (1985), and No. 6,523,919 B1 to Israelsen et al. (2003). Part of this group are also foreign applications—Japan 5-176815 to Takashima Makoto (1993), Japan 5-228034 to Imai Yoko (1993), and No. 4,799,743 to Kikuchi et al. (1989), also U.S. Pat. No. 4,808,925 to White (2003). The above listed inventions are not comparable, due to the difficulty of use of by handicapped person(s), or persons of short statue or more commonly called "Little People."

The Second Group is somewhat closer to the intent of this application. Their inventions, in addition to mechanical means of movement used by the first group, they use electric motors to initiate movement in both directions. The movement is down and up or out and back in. Each movable item such as the cabinet and shelving unit, has its own electric motor.

For example: U.S. Pat. No. 2,429,523 to Murphy (1947), No. 3,116,910 to Moore et al. (1964), No. 4,915,461 to Kingsborough et al. (1990), No. 5,228,763 to Gingold (1993), No. 5,249,858 to Nusser (1993), No. 5,586,816 to Geiss II (1996), No. 5,867,847 to Klawitter et al. (1999), No. 5,909,933 to Keene et al. (1999), No. 5,230,109 to Zaccai et al., (1993), No. 3,361,510 to E. P. McDermott (1968), No. 6,367,898 B1 to Jobe (2002), No. 5,076,649 to Therkelsen (1991), and App. No. US 2008/0211364 A1 to James Solheid et al.

The common denominator of the inventions listed in the second group above is:

A) Necessary close proximity of electric motor with all other parts to designated unit. This results in occupying valuable usable interior space, creating a noisy environment, difficult access for ongoing maintenance and future repairs, therefore it is inconvenient, and a high cost to operate.

B) Fact, each operating unit (cabinet, shelving unit, etc.) needs its own electric motor to function and this results in a high initial cost, and follow up higher maintenance.

C) Total dependency on delivery of electric power from a public grid, to be able to function. In case of a power outage, all movements will come to an abrupt hold. This would result in an immediate loss of usability, safety, and creates an overall inconvenience.

D) Nonexistence of emergency back-up system provisions.

SUMMARY

Due to the high cost, inconvenience, and impractical nature of previous inventions or moveable cabinets, I have created a unique system. My system uses pneumatic power media, supported by a low-voltage electric system. The use of pneumatic powered movable cabinets results in many advantages for the user. Whether the user is handicapped, short of stature, or just desiring a more economical and efficient working home environment. My cabinet system allows for easy reaching cabinets with little effort but to touch a switch.

DRAWINGS

Figures

*In the below drawings, closely related figures and some components have been used with the same numbers but different alphabetic suffixes*

FIG. 1—Shows Pneumatic power equipment system.

Figure 2:
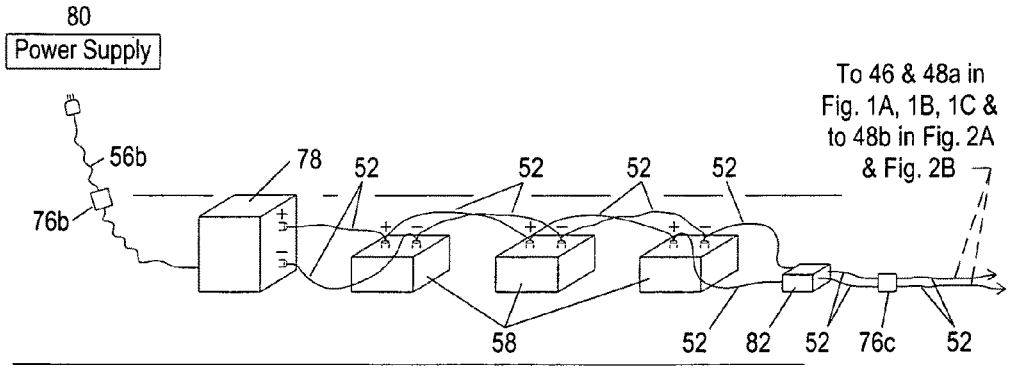

FIG. 2—Shows low voltage electric system.

Figure 1A:
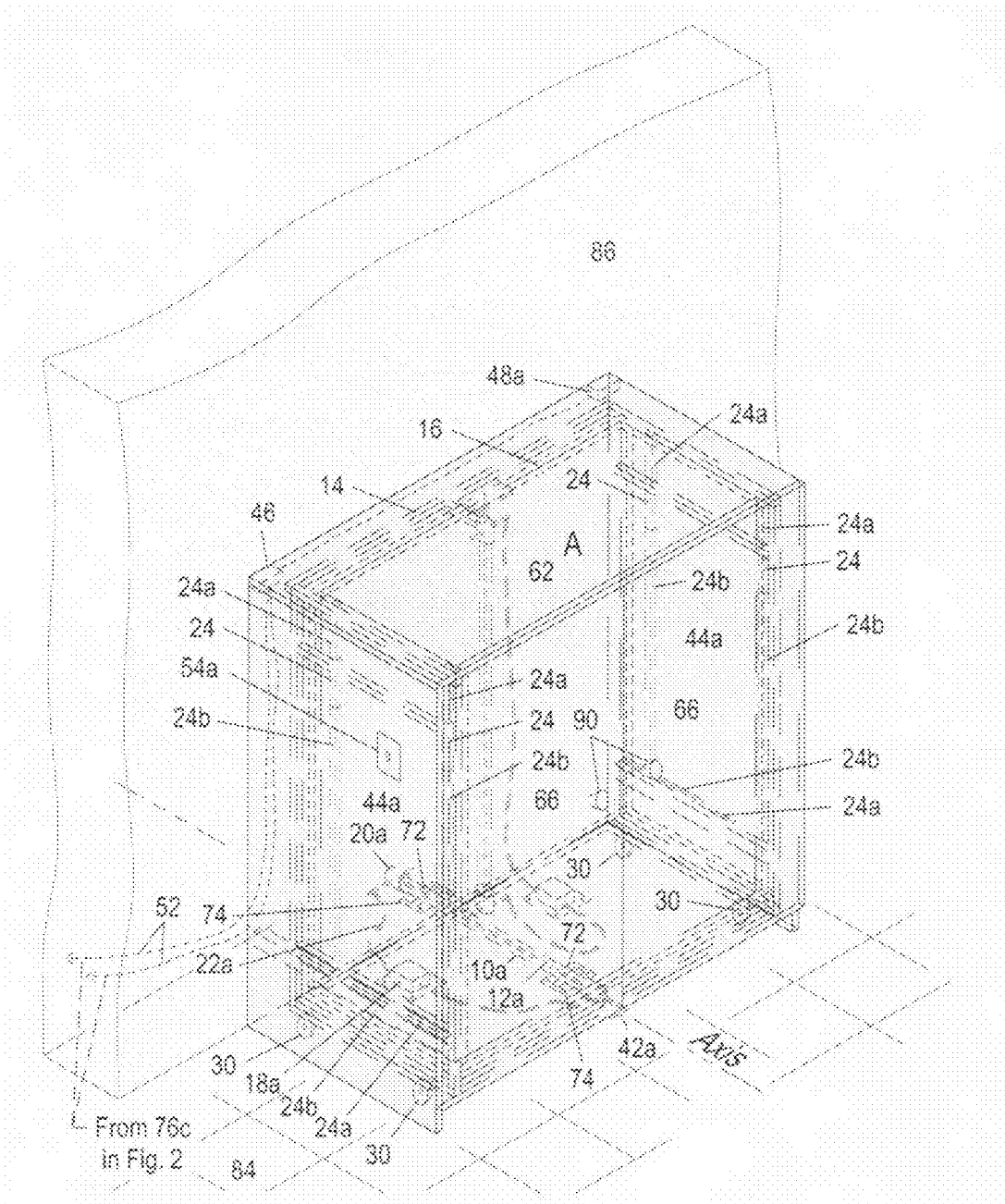

FIG. 1A—Shows cabinet A—floor mounted—in initial, closed position.

Figure 1B:
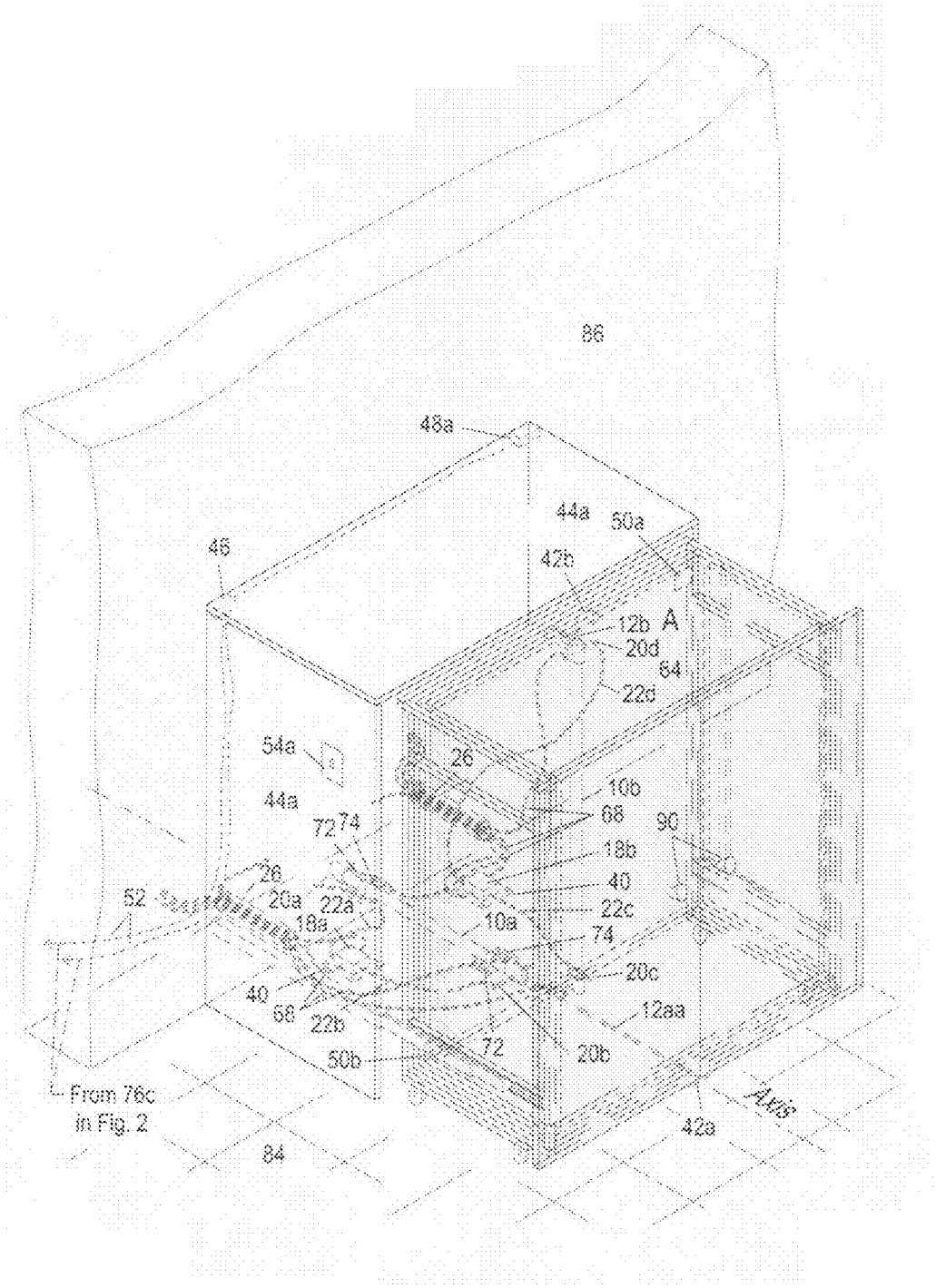

FIG. 1B—Shows cabinet A in horizontally extended position.

Figure 1C:
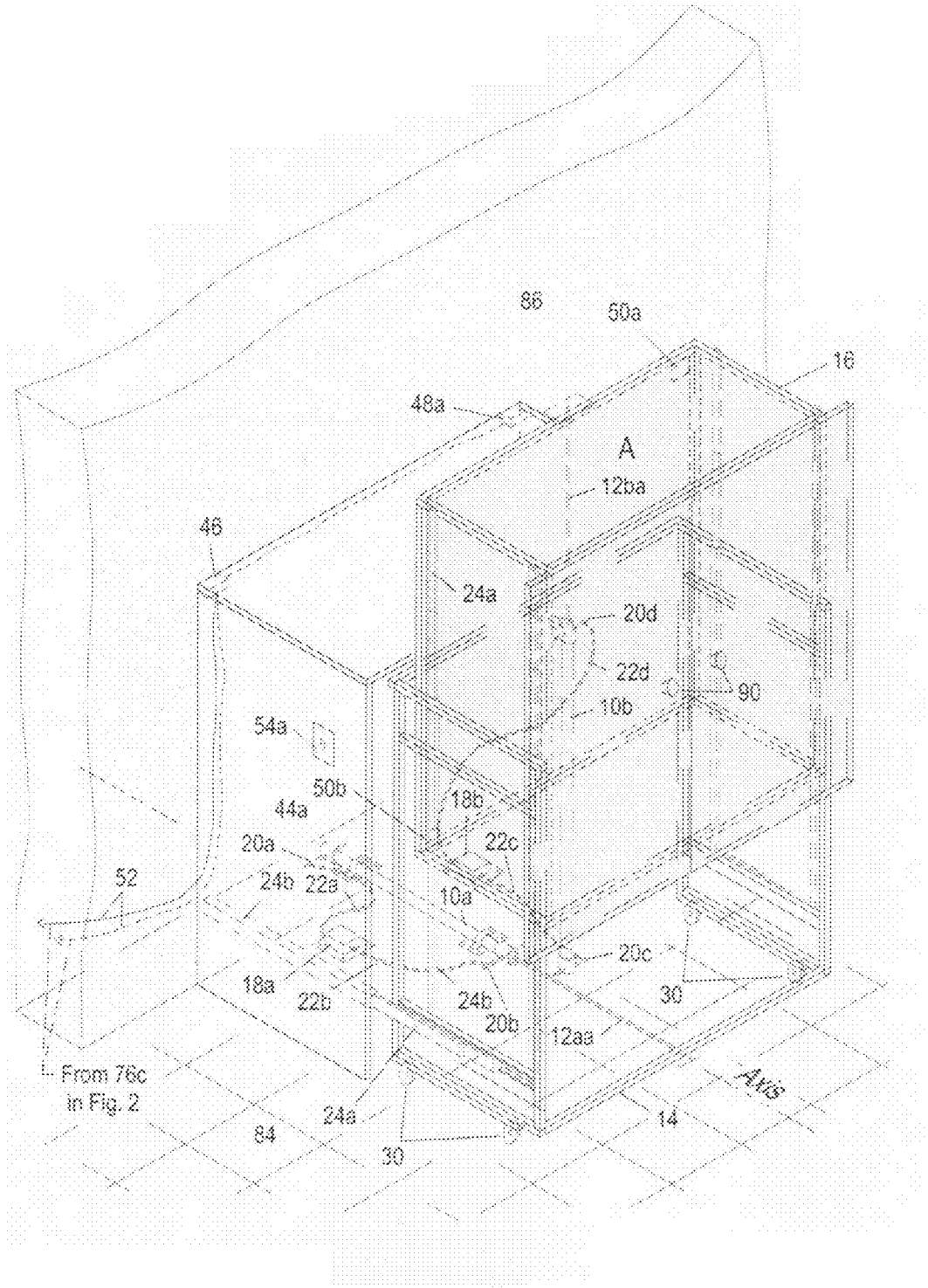

FIG. 1C—Shows cabinet A in vertically elevated position.

Figure 2A:
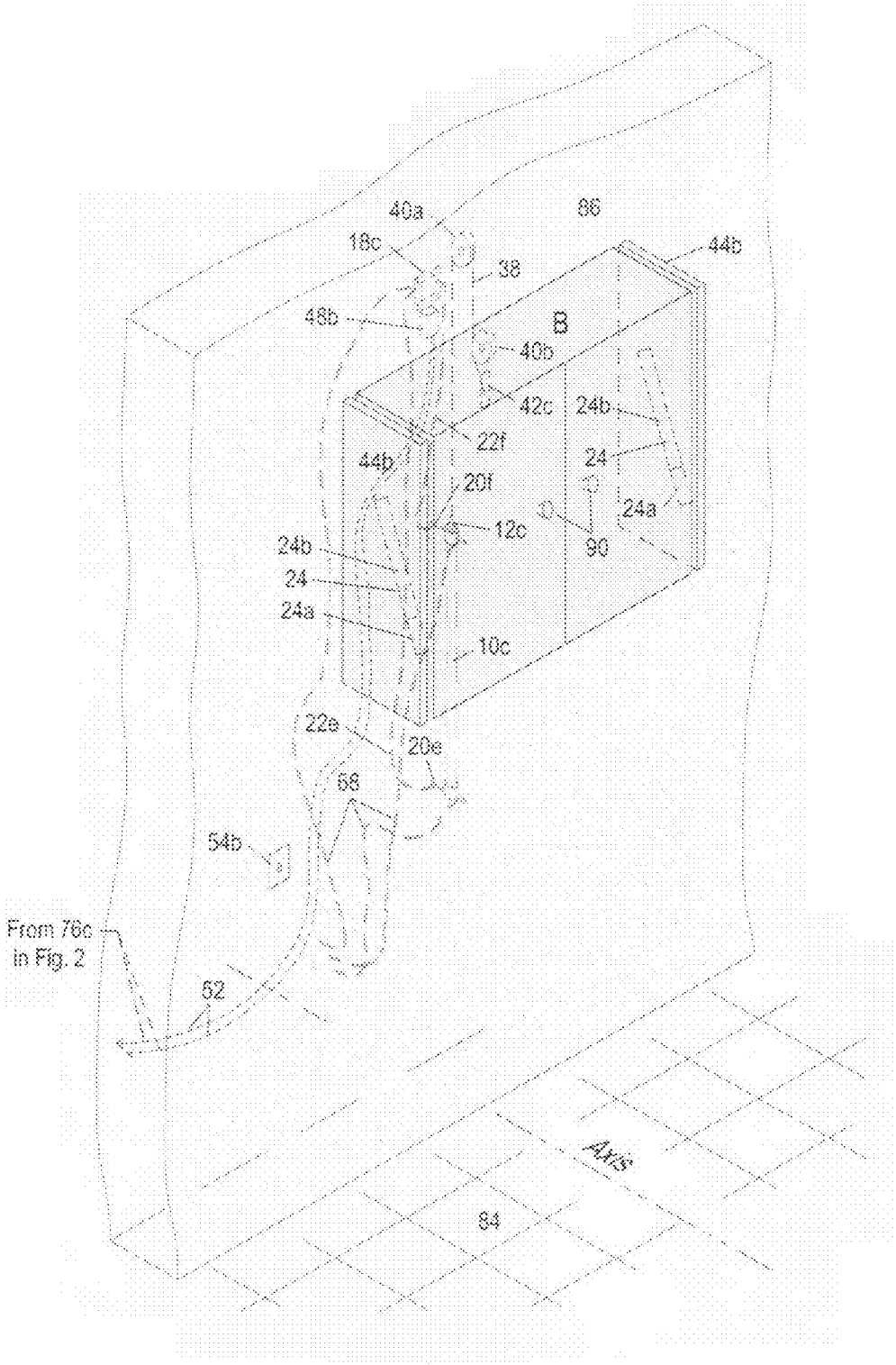

FIG. 2A—Shows cabinet B—wall mounted—in initial, closed position.

Figure 2B:
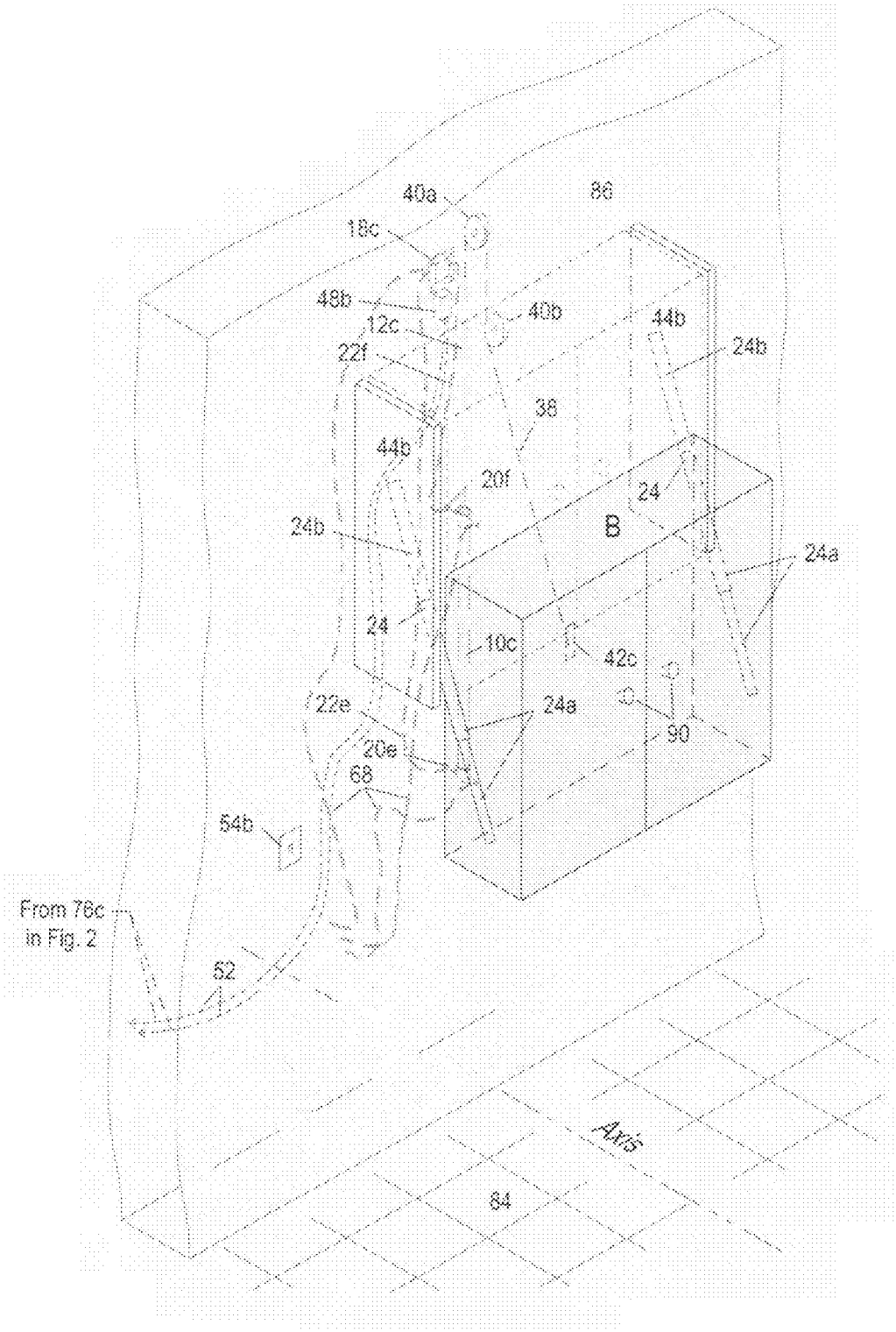
Figure 0:
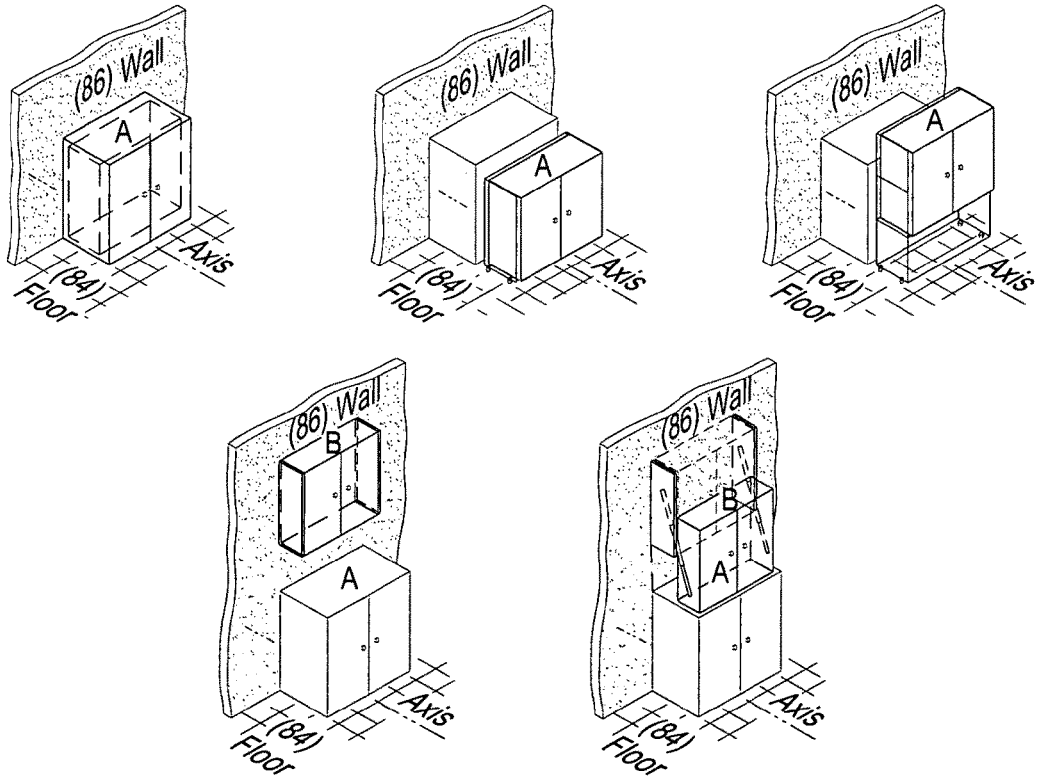

FIG. 2B—Shows cabinet B in lower, diagonally extended position.

FIG. "0"—3-D Drawings showing elevations for publication and readers orientation

DRAWINGS

Reference Numerals

A. Lower Cabinet—Floor Mounted:

B. Upper Cabinet—Wall Mounted:

10. Air piston, body (cylinder body) a, b, c

12. Air piston, rod (cylinder rod) a, b, c aa, ba

14. Outer frame—Lower

16. Inner frame—Upper

18. Solenoid air conirol valve a, b. c

20. Air How control valve a, b, c, d, c, f

22. A.S.T.—Air Supply Tube, a, b, c, d, c, f

24. Slider guides—Runner—sliding part—a Slider guides—Runner—stationary part—b

26. Sleeve pipe

28. T=Air supply tube connector

30. Caster wheel

32. Air compressor
34. Air reservoir lank
36. Air manifold
38. Aircraft cable or wire rope
40. Slicaves, fixed, a, b
42. Steele bracket, a, b, c
44. Side divider, a, b
46. J bar
48. J bar a, b
50. Cabinet clearance switch a, b
52. Straigh insulated wire
54. Electric switch operational a. b
56. 110 voll electric supply cord or 220 volt
58. Low voltage battery gang supply power.
60. Sound insulated enclosure, vented to outside air
62. Counter top
64. Extended counter top
66. Front access doors
68. Discharge air vent tube
70. Vent pipe to outside air
72. Clamp
74. Sleeper, spacer, with fastener to floor
76. Electric switch, a, b, c—safely
78. Charger
80. Power supply source.
82. Power supply pack
84. Floor
86. Wall
88. Related components
90. Cabinet door knobs Note: Items (26) sleeve, and (52) streigh insulated wire, have no additional suffix numbers. They are to be placed and used as per each local individual project design. The same rule applies for items (68) Discharge air vent tube, item (72) clamp, and item (74) sleeper spacer with fasteners to surface. Sleeper is built with a suitable piece of material, such is plywood, to accommodate any difference in elevation of adjacent materials or their parts. Item (22), A.S.T., have suffix numbering in locations needed for detailed description, only. Any other A.S.T. is referred to as (22).

First Embodiment

Detailed Description—FIGS. 1, 2, 1A, 1B, 1C

FIG. 1: Remotely located—for sound insulation purposes—air compressor (32), as a single source of power for operating of several locations of movable cabinets, with reservoir air storage tank (34) next in line, is providing more economical, ecology and safety friendly operational power system, placed inside sound insulated, vented to outside air (70) enclosure (60). Reservoir air storage tank (34) is supplying air to strategically—in relation to final destinations—located air manifold (36). Function of air manifold (36) is to distribute air power via air supply tubes AST (22) to solenoid control valves (18) located in each operational cabinet—in case of this application—cabinet A shown in FIGS. 1A, 1B,1C, and cabinet B shown FIGS. 2A and 2B. Where AST's (22) are placed inside walls, ceilings, floors, and other enclosed areas, they are protected by sleeves (26). Placement and use of sleeve (26)—which is a pipe of suitable diameter—also allow easy AST (22) replacement in case of repair and standard maintenance. Air compressor (32) is connected to local power supply (80) of 110 or 220 Volts, as available. Related components (88), such are valves, gages, etc., need to be designed and sized as per each individual project.

FIG. 2: Low Voltage battery gang (58) is providing a safe, sufficient electric power source via streigh insulated wiring (52) to power supply pack (82). Then, again thru wires (52), direct current is channeled to J bars (46), (48*a*), (48*b*), switches (50*a*),(50 b) and solenoids (18*a*),(18 *b*), and (18*c*), which are controlling movements of cabinets A and B in FIGS. 1A,1B,1C,2A, and 2B. Battery charger (78) is keeping gang of battery's operational at all times, but in case of power outage, system will remain operational for many more hours. Safety electric switches (76*b*), (76*c*) will allow standard maintenance and repairs.

FIG. 1A, 1B, 1C: As shown, cabinet A is located on floor (84), next to typical kitchen wall (86), mounted within frame (16), which function is to carry cabinet A up and down. Frame (16) has a four vertically mounted slider guides (24) where a sliding part (24*a*) is fastened to frame (16), and fixed part (24*b*) is mounted to frame (14). Function of frame (14) is to carry frame (16) including cabinet (A) forwards and backwards, using—4 caster wheels (30) along with two horizontally mounted slider guides (24), where sliding part (24*a*) is fastened to frame (16), and fixed part (24*b*) is fastened to side divider (44*a*), which could be adjacent to other movable cabinet. FIG. 1A is showing cabinet A as a "free standing", for simplicity of illustration. Slider guides (24), used to build prototype, are the same length and type, reason for same numbering.

First Embodiment

Operation Description—FIGS. 1, 2, 1A, 1B, and 1C

FIG. 1: Local power supply (80) provides electric power via supply cord (56*a*), intercepted by safety switch (76*a*) to air compressor (32). Sound insulated enclosure (60) is vented to outside air with vent pipe (70). This protects the air compressor (32) with all related components (88). Air generated by air compressor (32) is compressed to desired pressure. It is delivered via A.S.T. (22) through protective sleeve (26) to air reservoir tank (34). Then, the compressed air travels, via related components (88) and AST (22), to air manifold (36). Air manifolds (36) purpose, is to be able to distribute air to several cabinet locations. From Air manifold (36) compressed air is further traveling via A.S.T. (22) through "T" tube connector (28) again via A.S.T. (22) to final destinations. The final destination are solenoid air control valves (18*a*) in FIG. 1A, (18*b*) in FIG. 1B and (18*c*) in FIG. 2A. The reason for note in FIG. 1 "Future—to other locations" is for Readers clear understanding of possibility that other movable cabinets beside shown embodiments.

FIG. 2: Local power supply (80) is providing electrical power, via supply cord (56*b*), intercepted by safety switch (76*b*) to battery charger (78). Low voltage gang of batteries (58), connected via streigh insulated wires (52) to battery charger (78) and power supply pack (82). This provides a steady low voltage power supply to all final destinations. For this embodiments, from power supply pack (82), via wiring (52), interrupted by safety switch (76*c*), the low voltage power is reaching J bars (46). The low voltage power is additionally reaches J bar (48*a*) and (48*b*), shown in FIGS. 1A, 1B, 1C, 2A, and 2B. From those J bars, the low voltage power is further distributed to solenoids (18*a*), (18*b*), (18*c*), operational switches (54*a*), (54*b*) and clearance switches (50*a*), (50*b*), shown in the same Fig/s.

FIG. 1A: Upon initial command by switch (54*a*), solenoid valve (18*a*) will release compressed air via supply tube (22*a*) to air flow control valve (20*a*). This is attached to air cylinder (10*a*) where the air will push piston rod (12*a*), attached to bracket (42*a*), and frame (14) to extended position (12*aa*) shown in FIG. 1B. While frame (14) is extending, cabinet A simultaneously extends into position as shown in FIG. 1B. Air cylinder body (10*a*), located horizontally in axis below cabinet A, is attached to sleepers (74) and the floor with clamps (72).

FIG. 1B: While extended, by leaving the switch (54*a*) in an up position, clearance switch (50*a*) will command air control solenoid valve (18*b*). This will release compressed air via A.S.T. (22*c*) to air flow control valve (20*c*), attached to body of air cylinder (10*b*). Released compressed air, will push piston rod (12*b*) to extended new vertical position (12*ba*) shown in FIG. 1C.

FIG. 1C: Upper frame (16) and attached bracket (42*b*), with cabinet A will reach it's final position shown in FIG. 1C. Total length of travel going from beginning position 1A to position 1B to final position 1C is always determined and controlled by length of piston rod (2).

Return path from position shown in FIG. 1C back to position 1B and following to original position 1A occurs upon putting switch (54*a*) to opposite position from original. Electric power commands air control solenoid valve (18*b*) to release compressed air via A.S.T. (22*d*) to air flow control valve (20*d*), attached to air cylinder body (10*b*). At that time, compressed air will push piston rod (12*b*) from elevated position shown as (12*ba*). This along with attached inner upper frame (16) from an elevated position (FIG. 1C) towards previous position (FIG. 1B). The compressed air will be intercepted by manual switch (54*a*) to leave the cabinet A in (FIG. 1B) position for functioning as a counter top extension. Clearance switch (50*b*), will automatically signal air control solenoid valve (18*a*) to release air via A.S.T. (22*b*) to air control valve (20*b*). This will push air piston rod (12*a*) back inside air piston body (10*a*), to reach original position (FIG. 1A). This function will work along with attached frame (16) and mounted cabinet A inside, along with frame (14) on caster wheels (30).

1st Alternative Embodiment FIGS. 2A and 2B

Detailed Description

The purpose of this configuration is to allow persons bound in wheel chair, persons of short statue, persons suffering from vertigo and other handicappers, to reach and access upper wall mounted cabinets. While utilizing pneumatic power generating equipment described in FIG. 1 and same principles described in FIGS. 1A, 1B, and 1C, all persons listed above will be able to access cabinets. The entire purpose of this alternative embodiment is upon command the cabinet will come downwards, to consumers reach, as shown in FIG. 2B, and then upon command, return back as shown in FIG. 2A.

Operation Description:

FIG. 2A: Upon command via switch (54*b*), electric power will reach solenoid control valve (18*c*), which will release compressed air via A.S.T. (22*e*) to air flow control valve (20*e*) attached to air cylinder body (10*c*). Air piston rod (12*c*) is pushed upwards, and attached cable (38) travels thru sheaves (40*a*) and (40*b*) ending at bracket (42*c*), which is attached to cabinet (B).

Gravity allows cabinet B, shown in position FIG. 2A, to reach a lower position shown in FIG. 2B. This movement is controlled by extension of slider guides (24), where stationary part (24*b*) is attached to divider (44*b*), and sliding part (24*a*) is attached to cabinet B. While (12*c*) extends, the compressed air travels from air control valve (20*f*) via A.S.T. (22*e*) back to solenoid air control valve (18*c*). Air then escapes through vented exhaust port, which is build-in as a part of solenoid air control valve (18*c*), via A.S.T. (68) to outside.

FIG. 2B: To elevate cabinet B back to FIG. 2A, from lower position shown in 2B, is done by switch (54*b*), where electric power commands solenoid air control valve (18*c*). A.S.T (22*f*) then releases compressed air to air control valve (200. Air piston rod (12*c*) is pushed downwards, pulling along attached cable (38), which is traveling through sheaves (40*a*) and (40*b*) and pulling via attached bracket (42*c*) cabinet B. Length of air piston rod (12*c*) equals total length of travel of cabinet B.

Advantages:

Proposed embodiments attempt to resolve needed access to areas hard to reach for people with handicaps. Those bound in wheelchairs, suffering from vertigo, back problems, joint problems, people of short stature "Little People", on an affordable basis.

Use of pneumatic power media centrally located, is very economical, ecologically friendly, and safer then previously used electric motors. The use of a single source of power motion to operate movable cabinets makes it convenient as well. Air stored in the air reservoir tank will safely control the movement of several cabinets for many hours after any failure of a public electric grid delivery. Distant location of power center minimizes noise from operating movable cabinets, and allows easy access for standard maintenance and future repairs. Therefore the embodiment is very economical and user friendly.

Further, using low voltage power source to operate movable cabinets directly compliments and multiplies advantages of pneumatic power media by the low voltage used. As movable cabinets are often neighboring water usage fixtures such as faucets and sinks, danger of electric shock is minimized. Electricity stored in the low voltage power source allows a person(s) to safely control movements of several cabinets, in case of a public electric grid failure. Lastly, use of low voltage electric power system to operate pneumatically powered movable cabinets of proposed embodiment, opens additional economical avenues. These avenues can be alternative power sources such as solar and wind power to supply electric power for this proposed system.

Conclusions, Ramifications and Scope:

While my above description contains many specificities, these should not be construed as limitations on the scope, but rather as an exemplification of preferred 1st embodiment described in FIGS. 1A,1B,1C, also, in the 1st alternative embodiment shown in FIGS. 2A and 2B. First embodiment is showing movements of cabinet A, placed on floor in one room, horizontally and vertically. 1st alternative embodiment is showing movements of cabinet B, hung on the wall of one room, moving diagonally up and down.

Both cabinets, A and B, are the most commonly used configuration of placement and usage. Same, or similar cabinets, shelving units and other types of fixtures could be moved only horizontally within one room or thru wall protrusion from one room to the other; or vertically within one room only, or between two or more floors thru ceiling(s) protrusion (s). All, with use of one pneumatic power source. Accordingly, the scope should be determined not by the embodiments illustrated, but by the appended claims and their legal equivalents.

What is claimed is:

1. An accessibility and retrieval apparatus for use with floor mounted cabinets comprising:

a cabinet assembly attached to a floor and to a wall for providing a storage space for a movable cabinet, the cabinet assembly comprising: two spaced apart side-walls, a countertop and stationary parts of sliding guides attached to inner sides of each respective sidewall;

an outer frame housed within the cabinet assembly, the outer frame comprising: sliding parts of the sliding guides attached to outer sides of the outer frame, the sliding parts couple with the stationary parts for allowing horizontal movement of the outer frame with respect to the cabinet assembly, stationary parts of at least two sliding devices attached to inner surfaces of the outer frame, and casters or wheels fastened to a bottom part for facilitating horizontal movement;

an air cylinder body fixedly mounted horizontally to the floor and having a sliding rod operated by compressed air, attached to the outer frame to effect horizontal movement of the outer frame;

an inner frame housed within the outer frame, the inner frame comprising: sliding parts of the at least two sliding devices attached to outer surfaces of the inner frame and coupled with the stationary parts of the outer frame for moving the inner frame vertically with respect to the outer frame;

an air cylinder body fixedly mounted vertically to the outer frame and having a sliding rod operated by compressed air, attached to the inner frame to effect vertical movement of the inner frame;

a movable cabinet housed within the inner frame, the cabinet comprising: three side walls, a base plate and a top plate, and two hinged doors attached to a front face of the cabinet;

at least one solenoid air control valve, at least one airflow control valve and tube connections for supplying air to the cylinder bodies from a remote pneumatic supply center; and an electrical switch along with at least one positioning clearance switch connected to a power supply and to air flow control devices for allowing the inner frame to begin movement upwards towards a retrieval position;

wherein upon horizontal movement of the outer frame from the cabinet assembly, the inner frame is used to raise the cabinet to the retrieval position which is approximately eye level to a person seated in a wheelchair, with a centerline line of the cabinet being 38 to 40 inches or one meter above the floor.

2. The accessibility and retrieval apparatus according to claim 1, wherein the cabinet is fashioned out of light weight metal, aluminum or hardened plastic composites, with strengthened areas at corners of the walls.

3. The accessibility and retrieval apparatus according to claim 1, wherein the cabinet assembly is fashioned of wood based products.

4. The accessibility and retrieval apparatus according to claim 1, wherein the outer frame is fashioned out of light weight metal, aluminum or hardened plastic composites.

5. The accessibility and retrieval apparatus according to claim 1, wherein the inner frame is fashioned out of light weight metal, aluminum or hardened plastic composites.

* * * * *